United States Patent [19]

Hurst

[11] 4,195,580

[45] Apr. 1, 1980

[54] MOUNTING BLOCK FOR TUFTING MACHINE GAUGE PARTS

[76] Inventor: Kenneth Hurst, 1804 Tombras Ave., Chattanooga, Tenn. 37412

[21] Appl. No.: 969,856

[22] Filed: Dec. 15, 1978

[51] Int. Cl.[2] ..... D05C 15/00

[52] U.S. Cl. ..... 112/79 R

[58] Field of Search ..... 112/79 A, 79 FF, 79.5

[56] References Cited

U.S. PATENT DOCUMENTS 4,067,270 1/1978 Short ..... 112/79 R

*Primary Examiner*—Ronald Feidbaum

*Attorney, Agent, or Firm*—Alan Ruderman

[57] ABSTRACT

A knife block and looper mounting block having a plurality of grooved retaining plates positioned between and joined to the flanges of a body member. At least certain of the retaining plates have slots in the upper surface for receiving a clamping member for acting on the gauge parts. A multi-knife mounting block has the grooves of adjacent plates progressively disposed closer to one of the flanges and further than the other to correct for disalignment due to the rise in pitch angle between the knives and loopers.

9 Claims, 5 Drawing Figures

MOUNTING BLOCK FOR TUFTING MACHINE GAUGE PARTS

BACKGROUND OF THE INVENTION

This invention relates generally to tufting machines for forming pile fabric and more particularly to improve mounting blocks for carrying the loopers in these machines and the knives in cut pile tufting machines.

In a tufting machine an oscillating looper cooperates with a reciprocating needle to seize and form loops. In cut pile tufting machines an oscillating knife cooperates with each looper to cut the loops of yarn so formed. The loopers are mounted in a looper bar carried by support blocks secured to a rock shaft. The known looper bars have a plurality of slots cut therein for receiving the loopers which are secured by set screws in the bar. Thus, whenever the gauge, i.e., the spacing between adjacent loops in a row, of a machine is changed, a new looper bar must be installed, unless the new gauge is an integral multiple of the old gauge. This is a time consuming process because the bar must be aligned so that each looper is positioned to cooperate with its respective needle. Until recently in cut pile machines the knife blocks, which are mounted on a rock shaft, merely carried one or two knives. With the current trend toward fine gauge fabric, blocks carrying four knives have been proposed. One such proposal is illustrated in Short U.S. Pat. No. 4,067,270. However, when increasing from a two to a four knife blade holder, a block having a single web has no more strength, but takes a greater load. Moreover, because of this the number of knife blades that can be mounted in such a holder is limited.

SUMMARY OF THE INVENTION

The present invention provides mounting blocks and a method of manufacturing mounting blocks for carrying a plurality of tufting machine gauge parts, i.e., knives and loopers, utilizing a plurality of grooved retaining plates positioned between the flanges of a unitary body member and physically joined thereto. The mounting portion of the gauge parts are totally enclosed in the blocks. A mounting block can be provided which carries any convenient number of gauge parts. A significant advantage of the present invention is that knife blocks constructed in accordance with the principles of the invention have more strength and rigidity by the addition of additional retaining plates and carrying a greater number of knives. The blocks are in effect modules that can be removed when required and a new module installed. For example, a module or block of knife blades can be removed when the knives are dull and another inserted in its place. Then, while the machine is operating the dull knives can be removed from the block, sharpened and replaced in the block for later installation in the machine. Looper mounting blocks also can be readily removed from the machine when changing the gauge of the machine, however, if the blocks are designed for a proper small gauge, the same blocks may be used for the other gauges.

In carrying out the invention a series of standard retaining plates can be used for both the knife blocks and the looper blocks, only the flanged body member used for the blocks and the positioning of certain of the retaining plates in the blocks differ. In the knife block the plates are mounted on opposite sides of a central web with the plates on each side facing in the direction which provides a knife receiving channel on each side of the web. In a looper block all the plates face in the same direction and special end plates are required so that the gauge is maintained when the block abuts an adjacent block in the tufting machine. Moreover, when mounting a plurality of knives in a block the retaining plates may be constructed to compensate for the raise in pitch angle, which is the angle the knives blade faces make to the looper faces. Also a staggered knife arrangement can be readily constructed using two different retaining plates, i.e., one set of plates with the grooves offset relative to the grooves in the other set of plates. This is an advantage when knife blocks for a staggered needle cut pile tufting machine are required since in such knife blocks the alternate knives may be staggered or offset to the same extent as the needles.

Consequently, it is a primary object of the present invention to provide mounting blocks for carrying a plurality of tufting machine gauge parts which comprise a plurality of grooved retaining plates positioned between the flanges of a body member and joined thereto.

Another object of this invention to provide a method for manufacturing such mounting blocks.

It is a further object to provide a knife block having high strength and rigidity for carrying a plurality of tufting machine knives.

It is a still further object of this invention to provide a knife block, and method for manufacturing the same, which can carry any convenient number of knives desired.

BRIEF DESCRIPTION OF THE DRAWING

The particular features and advantages of the invention as well as other objects will become apparent from the following description taken in connection with the accompanying drawings, in which.

DETAILED DESCRIPTION OF THE PREFERRED EMBODIMENTS

Figure 1:
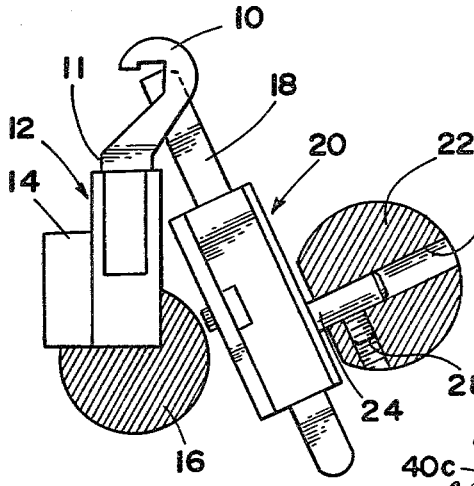
FIG. 1 is a side elevational view taken through the looper and knife shafts of a cut pile tufting machine incorporating looper and knife mounting blocks constructed in accordance with the present invention.

Referring to FIG. 1, shown are a plurality of tufting machine loopers 10 (only one of which is illustrated) having elongated mounting portions 11 carried in a looper mounting block generally indicated at 12 constructed in accordance with the principles of this invention, and which is in turn supported by a block support bar 14. The bar 14 may be suitably carried by a rock shaft 16 for rocking the loopers back and forth for seizing a loop of yarn from a needle (not shown) in a known manner. In cut pile machines the loopers 10 are rocked into cooperative position with respective knives 18 carried by knife blocks generally indicated at 20 constructed in accordance with the present invention. Each knife block in turn is supported on a rock shaft 22 by means of a support shaft or stud 24 received within a bore 26 in the shaft 22 and secured by set screws 28 or the like. The knives are thus oscillated back and forth into cutting engagement with yarn on the loopers.

Figure 2:
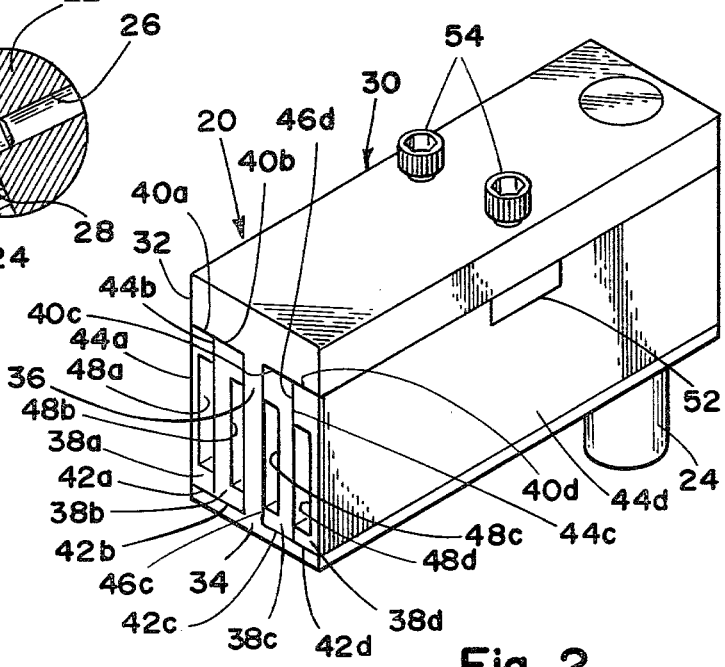
FIG. 2 is a perspective view of a four knife mounting block constructed in accordance with the principles of the present invention.
Figure 4:
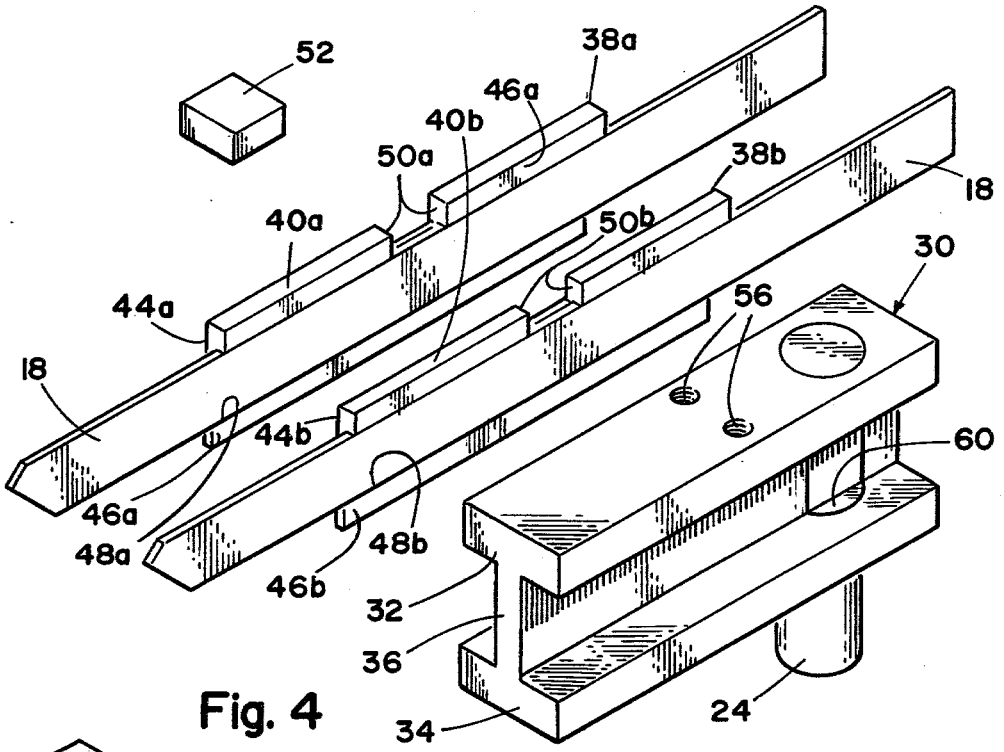
FIG. 4 is a disassembled perspective view of a four knife mounting block similar to that in FIG. 2 illustrating the assembly of the elements on the left side including the knives.

In accordance with the present invention a four blade knive block so constructed is illustrated in FIGS. 2 and 4 and comprises a unitary body member 30 having a pair of elongated parallel flanges 32 and 34 connected together by a substantially centrally disposed web 36. Positioned in the recesses between the flanges 32 and 34 are a plurality of elongated retaining plates 38*a*,38*b*,38*c*,38*d*. Each plate includes a respective top surface 40*a*,40*b*,40*c*,40*d* and a bottom surface 42*a*,42*b*,42*c*,42*d*, spaced apart by a distance substantially equal to the spacing between the flanges 32 and 34, and a pair of spaced apart front and rear surfaces 44*a*,44*b*,44*c*,44*d*, and 46*a*,46*b*,46*c*,46*d* respectively. Each plate has an elongated rectangular shaped groove 48*a*,48*b*,48*c*,48*d*, formed, as by milling, in the respective rear face 46*a*,46*b*,46*c*,46*d* for receiving the similarly shaped mounting portion of a knife 18. Thus, each retaining plate has a pair of flanges connected together by a web and is positioned within the recesses between the flanges of the body member 30. The plates adjacent the body member web 36 are positioned with their rear faces 46*b* and 46*c* abutting the web. The remaining plates are positioned in seriation with their rear faces abutting the front faces of the adjacent plate on each side of the central web 36. The plates are thereafter joined to the body member 30 as by brazing with a filler metal of the required strength, such as copper filler. The grooves in one plate form a knife receiving channel with the front face of the adjacent plate.

Figure 3:
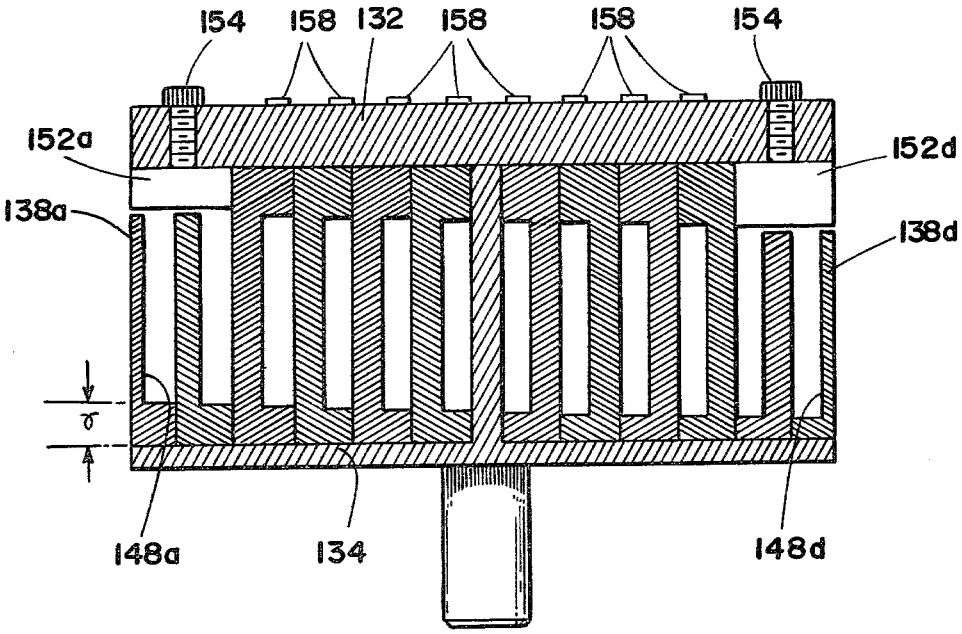
FIG. 3 is a cross sectional view taken through a block similar to that illustrated in FIG. 2 but illustrating a knife block for mounting twelve knives.

It can thus be seen that a knife block for carrying any desired number of knives can be constructed in this manner merely by proper sizing of the body member flanges 32 and 34. In FIG. 3, for example, a knife block that can carry twelve knives is illustrated. The addition of successive retaining plates increases the strength and rigidity of the block so block strength does not limit the number of knives carried. The retaining plates 38 may be standardized for the different gauge sizes, only the end plates 38*a* and 38*d* need be of a different size. For example, since the gauge is defined as the distance between corresponding points on the gauge parts, i.e., the knives, the width of the plates between the front and rear faces equals the gauge and the depth of the grooves equals the thickness of the knives. Thus, the thickness of the central web 36 is equal to the thickness of each web of all but the end plates, i.e., the difference between the plates between the front and rear faces and the depth of the grooves. The web of the end plates are approximately half this thickness so that when the knife blocks are mounted with clearance between adjacent blocks in the tufting machine the gauge is maintained throughout. Thus, the thickness of the end plates 38*a* and 38*d* are slightly less than half the sum of the thickness of the other plates and the depth of the grooves.

When mounted in a tufting machine the knife blade faces are set at an angle to the looper faces. This angle, known as a pitch angle, is formed by setting the knife block in the knife bar at an angle so as to provide a scissor-like cutting action. There is thus a slight disalignment of the knives of the successive knife blades. When adding more than four blades to a mounting block this disalignment is magnified. The present invention also provides a correction of this disalignment when required. For example, in the twelve bladed block of FIG. 3 the groove in each successive assembled retaining plate is elevated relative to the adjacent groove by an amount equal to the rise in the pitch angle. Thus, from the right side toward the left side of the block in FIG. 3 the grooves 148*a* through 148*d* are progressively further from the flange 134 and closer to the flange 132 and this progression is at the pitch angle $\gamma$ which should be between 3 to 5 degrees. Moreover, as stated above, alternate plates may have their grooves staggered for a staggered needle tufting machine.

In order to secure the knives in the channels between the retaining plates the retaining plates 38*a–d* may have a slot 50*a*, 50*b* for example, cut into the top surface 40*a*, 40*b* for receiving a clamping member 52 with minimal clearance and with one end flush against the web 36 and the other end flush to the outside retaining plate 38*a*. The bottom face of the clamping member will rest atop the top face of knives 18 positioned in the grooves. Headed screws 54 are threaded into holes 56 in the flange 32 and abut the clamping members 52 and when tightened exert a force on the knife faces to secure them in position. The clamping member should be used with the end two knives because of the narrower thickness of the retaining plates. As illustrated in FIG. 3 the knives in the remaining plate grooves can be secured with set screws 158, while clamping members 152*a*, 152*d* merely secure the last two knives in each end.

Figure 5:
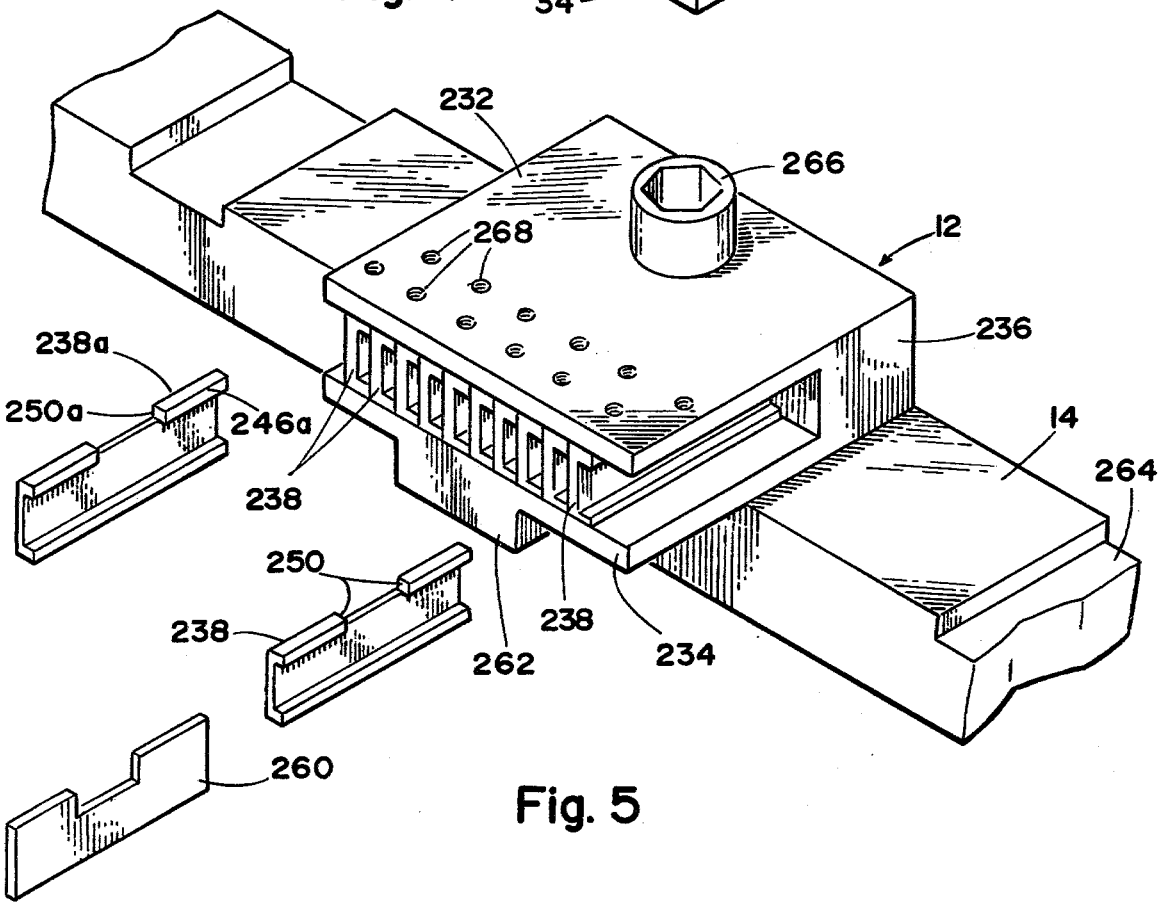
FIG. 5 is a perspective view partly disassembled of a looper mounting block constructed in accordance with the principles of the present invention.

In the looper mounting block 12 illustrated in FIG. 5 the flanges 232 and 234 are unitary with a laterally disposed web 236 and the retaining plates 238, which are all mounted with the rear face abutting the front face of adjacent plates, are disposed substantially normal to the web. A capping piece 260 being a substantially rectangular member is positioned against the rear face of the outermost plate to enclose the loopers. The block 12 may include a substantially rectangular shank or mounting portion 262 positioned in a groove 264 of the same shape in the mounting bar 14 and secured by a bolt 266. Since a number of looper blocks 12 will be mounted on a common mounting bar 14 the end plate 238*a* having its rear face 246*a* abutting the adjacent plate will be less than the thickness of the remaining plates by an amount equal to the difference between the thickness of the other plates and the capping piece. Ideally the capping piece 260 and the web of the plate 238*a* will each be equal to one half the difference between the thickness of the other plates and the depth of the groove, i.e., half the gauge minus the knife thickness. All the plates and the capping piece are joined to the flanges by brazing as stated above with respect to the knife block. Clamping blocks can be applied in the slots 250 in the end plates and capping piece as with the knife blocks, and set screws inserted in holes 268 to secure loopers in the channels formed by the other plates.

In practicing the method of this invention a rectangular block of metal may first have an aperture 60 drilled therethrough and the cylindrical shaft 24 inserted therein before the recesses forming the space between the flanges 32, 34 and web 36 are cut. The retaining plates are then shaped and the groove 48 cut. The plates are then positioned between the flanges and the plates and shaft joined by brazing or the like. The looper blocks are similarly formed.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed is:

1. A mounting block for a tufting machine for carrying a plurality of gauge parts each having an elongated mounting portion of substantially rectangular cross section, said block comprising a unitary body member having a pair of elongated substantially parallel spaced flanges, a plurality of elongated retaining plates having a pair of elongated surfaces spaced apart by a distance substantially equal to the spacing between said flanges, and elongated front and rear faces joining said surfaces, an elongated rectangular groove formed in each of the rear faces, the cross section of each groove corresponding to that of the mounting portion of said gauge parts, each of said retaining plates being disposed in seriatim intermediate and abutting said flanges, the front face of the plates abutting the rear face of the adjacent plate to define a plurality of enclosed elongated rectangular channels for receiving said gauge parts, and means for securing said gauge parts in respective channels.

2. A mounting block as recited in claim 1 wherein said body member includes an elongated substantially centrally disposed web integral with and interconnecting said flanges, said web having a thickness substantially equal to the difference between the thickness of said plates between said front and rear faces and the depth of said channel.

3. A mounting block as recited in claim 2 wherein substantially half of said plates are disposed on each side of said web, the rear faces of the plates adjacent said web being in abutting relationship with said web.

4. A mounting block as recited in claim 1 wherein the channels in adjacent plates are progressively disposed further from one of said flanges and closer to the other such that a plane passing through corresponding points in adjacent channels is disposed at an angle to said flanges.

5. A mounting block as recited in claim 4 wherein said angle is approximately 3 to 5 degrees.

6. A mounting block as recited in claim 3 wherein the plates disposed furthest from said web, defined as end plates, have a thickness from the front face to the rear face of substantially one-half the sum of the thickness of each of the other plates between said front and rear faces and the depth of each of said channels, at least said end plates have a slot formed in one of said elongated surfaces, said means for securing said gauge parts includes a clamping member positioned in said slot and having means adapted to engage the mounting portion of the gauge part in said channel, and means for forcing said clamping member toward said gauge part and for securing said clamping member.

7. A mounting block as recited in claim 1 wherein said body member includes a laterally disposed web integral with and interconnecting said flanges, said plates being disposed in planes substantially normal to said web.

8. A mounting block as recited in claim 7 wherein said body member has a finite width, an end plate disposed on one extremity having the rear face facing outwardly from the remaining plates of said body member, the thickness of said end plate from the front face to the rear face being less than the thickness of each of the other plates, the other extremity having a capping piece of a thickness substantially equal to the difference between the thickness of each of said other plates and said end plate.

9. A mounting block as recited in claim 8 wherein said means for securing said gauge parts includes a slot formed in one of said longitudinally extending surfaces in said end plate, and a slot formed in a parallel surface of said capping piece, and the plate adjacent thereto, a clamping member positioned in each slot and having means adapted to engage the mounting portion of the gauge part in the channel in the end plate and in the plate adjacent the capping piece, and means for forcing said clamping members toward the respective gauge parts and for securing the clamping members.

* * * * *